US005954540A

United States Patent [19]

Wu

[11] Patent Number: 5,954,540

[45] Date of Patent: Sep. 21, 1999

[54] SHELL MEANS FOR USE WITH MINI ELECTRICAL CONNECTOR

[75] Inventor: Kun-Tsan Wu, Tu-chen, Taiwan

[73] Assignee: Hon Hai Precision Ind. Co., Ltd., Taipei Hsien, Taiwan

[21] Appl. No.: 08/960,426

[22] Filed: Oct. 31, 1997

[51] Int. Cl.[6] ..... H01R 13/648

[52] U.S. Cl. ..... 439/607; 439/609

[58] Field of Search ..... 439/607–610, 439/92, 95, 101, 108, 675

[56] References Cited

U.S. PATENT DOCUMENTS

| | | | |
|---|---|---|---|
| 5,178,562 | 1/1993 | Ermini | 439/609 |
| 5,288,248 | 2/1994 | Chen | 439/609 |
| 5,622,523 | 4/1997 | Kan et al. | 439/607 |
| 5,755,595 | 5/1998 | Davis et al. | 439/607 |
| 5,766,041 | 6/1998 | Morin et al. | 439/609 |

*Primary Examiner*—Khiem Nguyen

[57] ABSTRACT

A shell means for use with a mini electrical connector, comprises: a mating surface, two opposite lateral surfaces and a top surface wherein the top surface integrally extends from the right lateral surfaces. The lateral surfaces further include a plurality of first retentive sections thereon and the top surface includes a second retentive section thereon. A third retentive section is formed between the top surface and the left lateral surface for retaining the top surface and the left lateral surface together. A grounding portion integrally extends from either the top surface or the mating surface away from the shell means for electrically engaging with an exterior grounding conductor. By means of the first, the second and third retentive sections, the shell means is easily and actually assembled onto an insulative housing of the mini electrical connector for connector manufacturers.

9 Claims, 5 Drawing Sheets

SHELL MEANS FOR USE WITH MINI ELECTRICAL CONNECTOR

BACKGROUND OF THE INVENTION

1.Field of The Invention

The present invention relates to a shell means for use with a mini electrical connector, and particularly to a shell means easily assembled onto an insulative housing of the mini electrical connector.

2.The Prior Art

At present, the trend of market demand for computerized products favors a light, compact and delicate design. For example, computerized systems or peripherals are now available in convenient portable models. However, as the further miniaturization of the computer advances, electrical assemblies deposited within a computerized system must also be miniaturized to be accommodated within the interior space of the compact computer systems. In such electrical assemblies, electrical connectors occupy the most space in the computer system. Therefore, it is very important for connector manufacturers to miniaturize the electrical connectors or to reduce space occupied by the electrical connectors on the computer system.

Unfortunately, the miniature design of conventional mini electrical connectors deposited within the miniaturized computer system are still space inefficient. The results from conventional electrical connectors requiring extra structures therein to cooperate with a grounding means or a shielding means for providing grounding protection or shielding protection against electromagnetic interference (EMI) or electrostatic discharge (ESD), i.e. insulative housings of some of connector have to provide a structure forming a number of screw holes to retentively cooperate with corresponding bolts for retaining the shell means onto the housing.

Other conventional electrical connectors reduce the occupied space by sacrificing the mentioned structures thereof resulting in a reduced retentive effect between the connectors and the shielding means or grounding means.

In addition, a shell means of the conventional electrical connector generally consists of multiple metal sheets which require the use of exterior tools to assemble the multiple shell means onto the housing of the electrical connector. Therefore, the assembly thereof is complicated and increases labor for the connector manufacturers.

The foregoing conventional electrical connectors are disclosed in Taiwan Patent Application Nos. 77,208,107, 78,204,790, 80,104,898, 80,208,342, 80,211,820, 82,111,200, 82,201,874 and 84,201,441, and U.S. Pat. Nos. 4,637,669, 4,842,554, 4,842,554, 4,842,555, 4,908,335, 4,995,819, 5,017,158 and 5,186,633.

Accordingly, for resolving the above disadvantages, an object of the present invention is to provide a shell means for use with a mini electrical connector, which includes a first retentive section, a second retentive section and a third retentive section to enhance the retentive effect between the shell means and a housing of the connector.

Another object of the present invention is to provide a shell means for use with a mini electrical connector, which includes a third retentive section formed on the shell means and consisting of a loop and a tongue with a clasp. By means of cooperation between the loop and the tongue, the shell means is easily and conveniently assembled onto an insulative housing of the mini electrical connector.

Another object of the present invention is to provide a shell means consisting of a plurality of surfaces wherein one of surfaces integrally forms a grounding portion thereon for reducing space occupied by the mini electrical connector on the circuit board and for convenience of assembly.

An insulative housing of the mini electrical connector cooperating with the shell means of the present invention is similar to the disclosure of co-pending patent application No. 08/933,408 filed on Sep. 19, 1997.

SUMMARY OF THE INVENTION

According to an aspect of the invention, a shell means for use with a mini electrical connector to electrically connect an exterior mating connector to a circuit board comprises: a mating surface, two opposite lateral surfaces, a top surface and a grounding portion wherein all of the surfaces collectively define a receiving space for receiving an insulative housing of the mini electrical connector. The lateral surfaces further include a plurality of first retentive sections thereon and the top surface includes a second retentive section thereon. A third retentive section consists of a loop protruding from the left lateral surface, and a tongue extending from the top surface for cooperating with each other to retain the top surface and the left lateral surface together. The grounding portion integrally extends from either the top surface or the mating surface away from the shell means to electrically engage with an exterior grounding conductor for grounding protection. By means of the first, second and third retentive sections, the shell means is easily and actually assembled onto an insulative housing of the mini electrical connector.

DETAILED DESCRIPTION OF THE PREFERRED EMBODIMENTS

Figure 1:
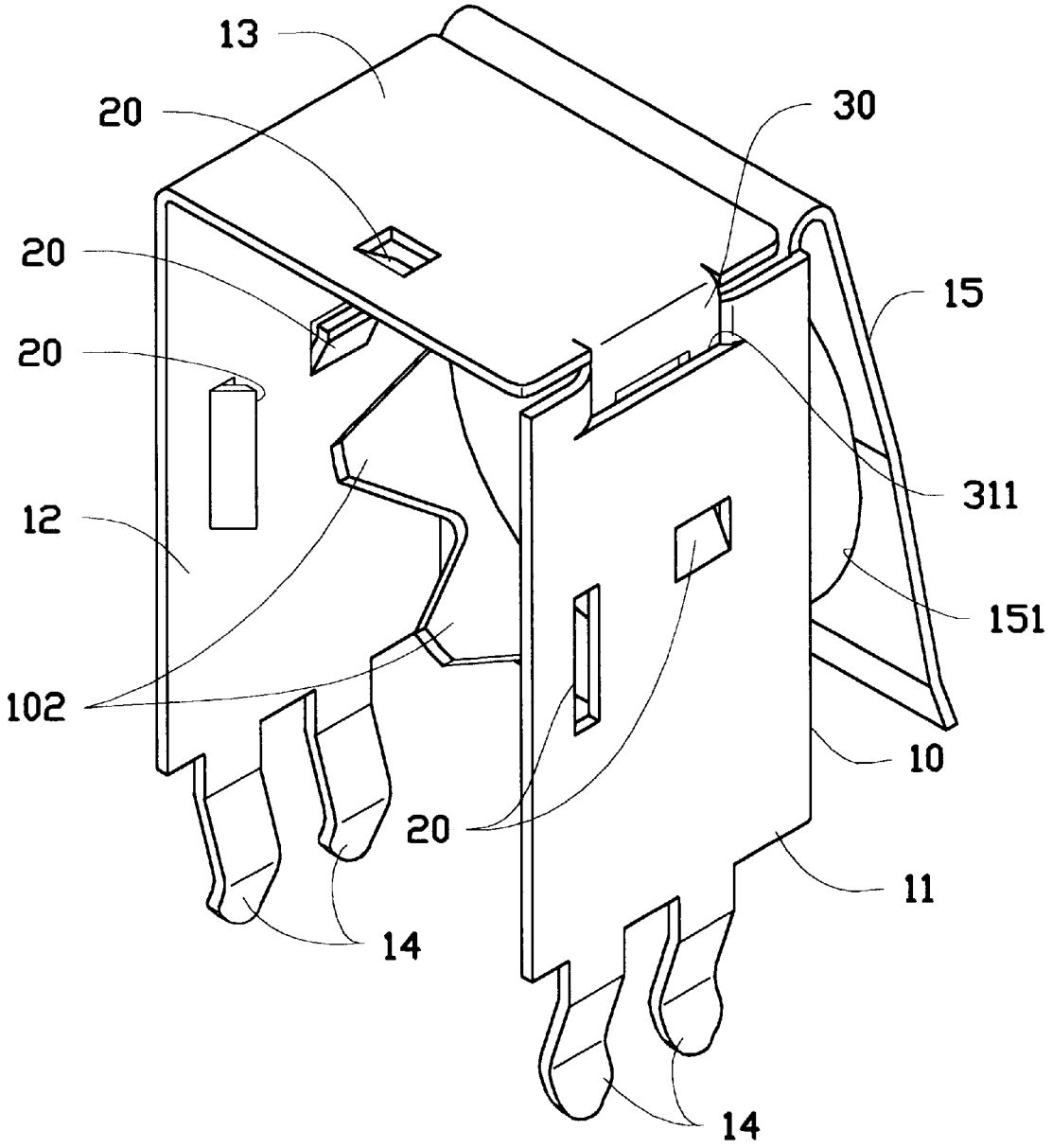
FIG. 1 is a perspective view of a shell means of a first embodiment in accordance with the present invention showing an outer top and right surface, an inner left surface and a receiving space thereof.

References will now be made in detail to the preferred embodiments of the present invention. The structure of an insulative housing of a mini electrical connector cooperating with a shell means (seen in FIGS. 1–3, 4A & 4B) of the present invention, is similar to the disclosure of co-pending patent application No. 08/933,408 filed on Sep. 19, 1997, and therefore is not shown in the drawings of the preferred embodiments of the present invention.

Figure 2:
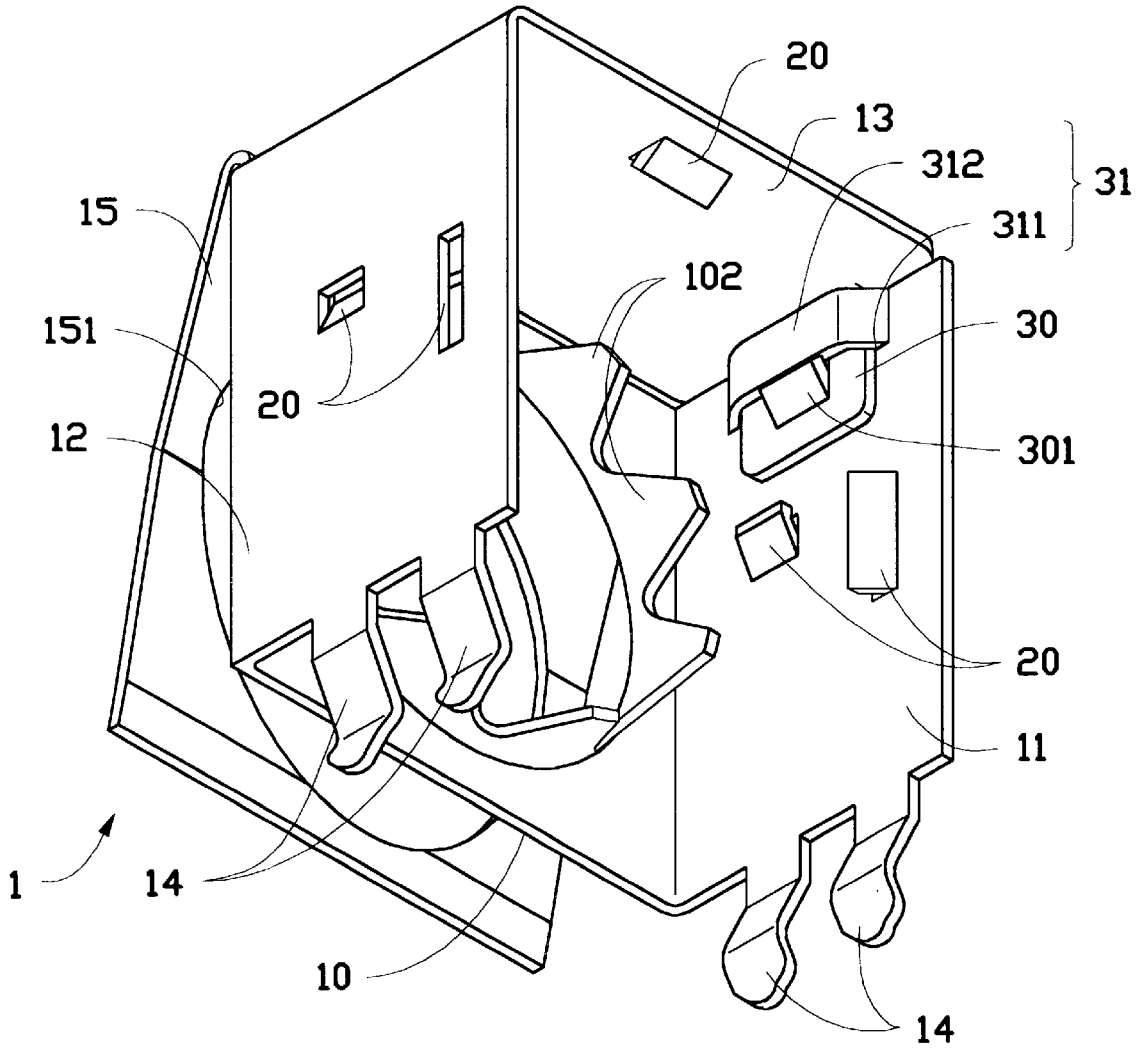
FIG. 2 is another perspective view of the shell means of the first embodiment in accordance with the present invention showing inner top and right surfaces, an outer left surface and the receiving space thereof.
Figure 3:
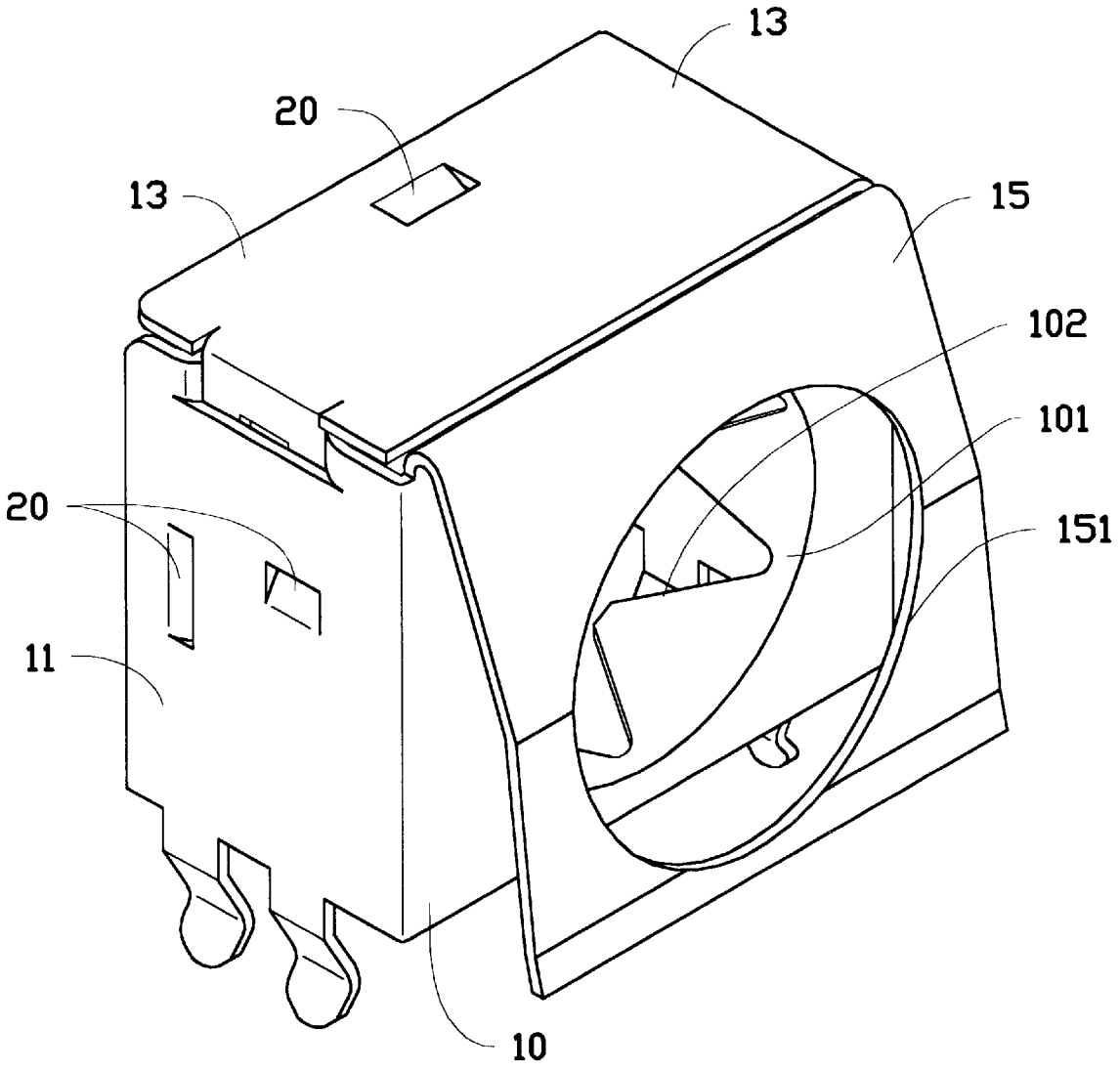
FIG. 3 is another perspective view of the shell means of the first embodiment in accordance with the present invention showing the outer top, right and front surfaces thereof.

A first embodiment of the present invention is indicated in FIGS. 1–3. A shell means (1) is formed from a metal sheet by stamping for use with a mini electrical connector which is used to electrically connect an exterior connector (not shown) to a circuit board (not shown). The shell means (1) comprises a mating surface (10), a top surface (13) and two opposed lateral surfaces (11, 12) wherein the opposed lateral surfaces (11, 12) respectively and integrally extend from the right edge and the left edge of the mating surface (10), and the top surface (13) integrally extend from a top edge of the right lateral surface (12). Said surfaces (10, 11, 12, 13) further collectively define a receiving space (not labeled) for receiving an insulative housing (similar to the disclosure of co-pending application No. 08/933,408) therein.

A mating opening (101) is generally formed on a middle position of the mating surface (10) and communicates with said receiving space and an outside of the mating surface (10), for receiving the exterior mating connector therein. A teeth-shaped crown portion (102) extends from a border of said mating opening (101) into said receiving space for electrically engaging with a shell (not shown) of the exterior mating connector. An elastic grounding portion (15) is integrally formed with a top edge of the mating surface (10) and slantingly extends away from the shell means (1). The grounding portion (15) includes an outer opening (151) and an outward bend (not labeled) both of which are generally located in a middle area thereof wherein the outer opening (151) aligns with said mating opening (101) of the mating surface (10) for receiving the exterior mating connector. The outward bend of the grounding portion (15) is adapted to elastically and electrically engage with an exterior grounding conductor, such as a panel of the computer enclosure (not shown), to establish grounding protection for the mini electrical connector when the connector is seated on the circuit board of the computer system (not shown).

A first retentive section (not labeled) is formed in a middle area of each lateral surface (11, 12) and consists of a horizontal clasp (20) and a vertical clasp (20) both extending toward said receiving space for retaining the lateral surfaces (11, 12) on opposite sides (not shown) of the housing. A plurality of elastic board locks (14) are respectively formed on a bottom edge of each lateral surface (11, 12) for locking with associated apertures (not shown) defined in a surface of the circuit board, and for electrically engaging with a number of grounding circuits (not shown) next to the apertures.

A second retentive section as a clasp (20) positioned on the top surface (13) near a rear portion extends toward the receiving space for retaining the top surface (13) on a top wall of the housing (not shown). A third retentive section located between the left lateral side (11) and the top surface (13), consists of a loop (31) formed on the left lateral side (11) and a tongue (30) formed on the top surface (13) for cooperation with each other to retain both surface (11, 13) together. The loop (31) protrudes from a top edge of the left lateral side (11) to define a slot (311) and a bridge surface (312). The tongue (30) is perpendicularly bent downward from a left edge of the top surface (13) and forms an upward clasp (301) thereon.

Regarding the assembly of the shell means (1), the top surface (13) is perpendicularly bent downward relative to the right lateral surface (12) resulting in the shape as shown in FIGS. 1–3 wherein the tongue (30) having the clasp (301) can be instantly snapped within the loop (31) of the left lateral surface (11) through the slot (311). By means of the first, second and third retentive sections, the shell means (1) is able to actually restricted from movement in multiple directions. Therefore, the shell means of the present invention is easily and conveniently assembled onto the housing of the mini electrical connector.

Figure 4A:
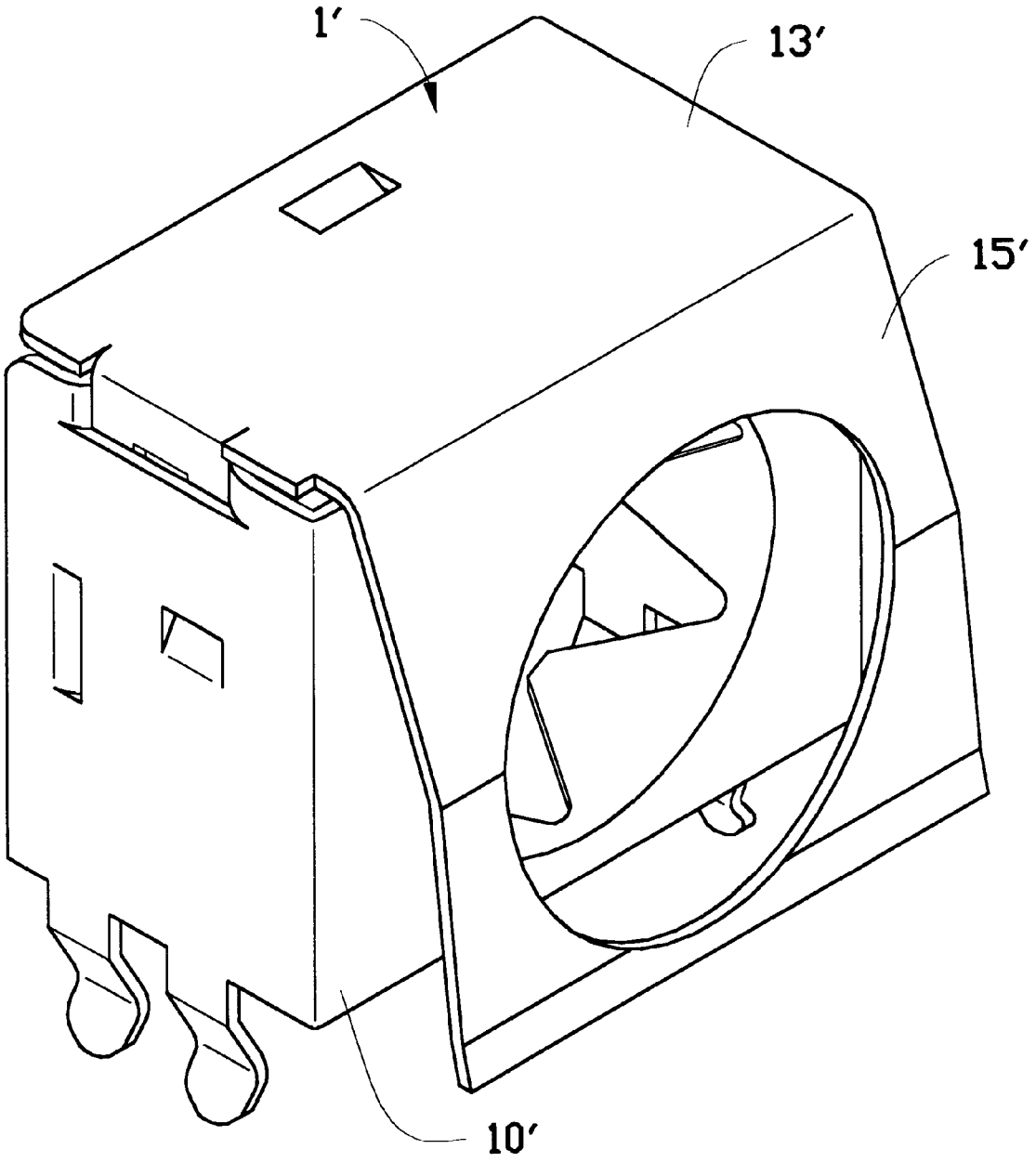
FIG. 4A is a perspective view of a shell mean of a second embodiment in accordance with the present invention showing the outer top, right and front surfaces thereof.
Figure 4B:
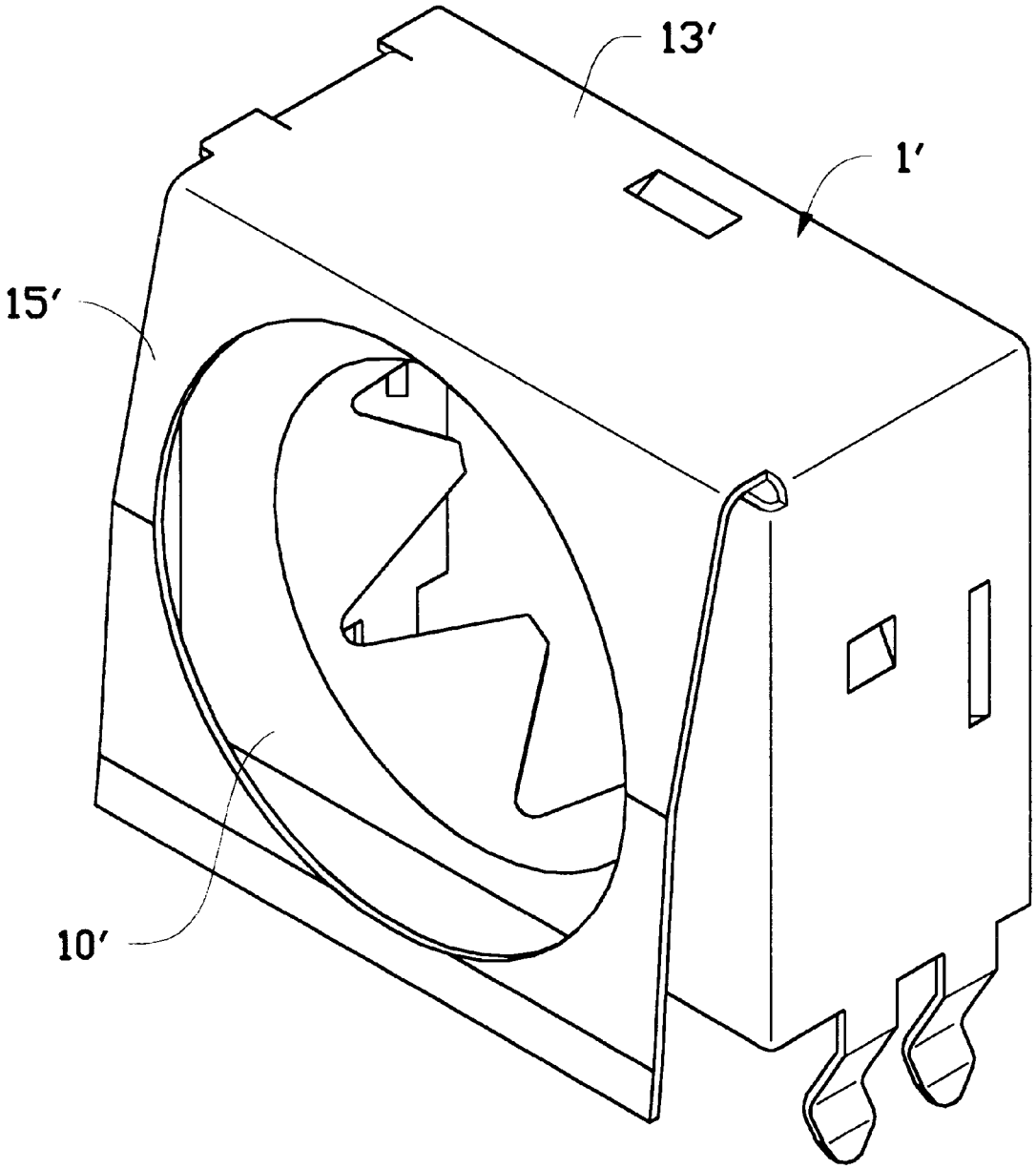
FIG. 4B is another perspective view of the shell means of the second embodiment in accordance with the present invention showing the outer top, left and front surfaces thereof.

In addition, a shell means (1') of a second embodiment in accordance with the present invention indicated in FIGS. 4A & 4B is similar to that of the first embodiment. The only difference is that the grounding portion (15') integrally extends from a front edge of the top surface (13'), rather than from the top edge of the mating surface (10'). However, the function of the second embodiment is consistent with the first embodiment.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A shell means for use with a mini electrical connector electrically connecting an exterior mating connector to a circuit board, comprising:

a plurality of surfaces collectively defining a receiving space for receiving an insulative housing of the mini electrical connector wherein one of the surfaces forms thereon a mating opening communicating with said receiving space for receiving the exterior mating connector; and a grounding portion integrally extending from an edge of one of the surfaces away from the shell means for electrically engaging with an exterior grounding conductor for grounding protection; wherein said grounding portion further forms thereof an outer opening in alignment with the mating opening.

2. The shell means as described in claim 1, wherein the surfaces consist of a mating surface, a top surface and two opposite lateral surfaces wherein said mating opening is formed on the mating surface.

3. The shell means as described in claim 2, wherein the opposite lateral surfaces are respectively formed on opposite lateral edges of the mating surface.

4. The shell means as described in claim 2, wherein the grounding portion is integrally formed with a top edge of said mating surface.

5. The shell means as described in claim 2, wherein the grounding portion is integrally formed with a front edge of said top surface.

6. The shell means as described in claim 1, wherein a crown portion extends from a border of said mating opening into said receiving space for electrically engaging with a shell of the exterior mating connector.

7. A shell means for use with a mini electrical connector electrically connecting an exterior mating connector to a circuit board, comprising:

a mating surface forming thereof a mating opening for receiving the exterior mating connector;

at least one lateral surface located at a lateral edge of the mating surface;

a top surface located at a top edge of the mating surface;

a grounding portion integrally extending from either a front edge of the top surface or a top edge of the mating surface away from the shell means for electrically engaging with an exterior grounding conductor for grounding protection;

a plurality of elastic board locks formed on a bottom edge of the lateral surface, for locking with associated apertures formed in the circuit board; wherein said grounding portion defines an outer opening in alignment with the mating opening.

8. The shell means as described in claim 7, wherein the mating surface, the lateral surface and the top surface collectively define a receiving space communicating with the mating opening for receiving an insulative housing of the mini electrical connector.

9. A shell means for use with a mini electrical connector electrically connecting an exterior mating connector to a circuit board, comprising:

a first surface forming thereon a mating opening for receiving the exterior mating connector;

a second surface and a third surface respectively located at different edges of the of the first surface;

a fourth surface integrally extending from the second surface;

at least one retentive section formed between the third surface and the fourth surface for retaining the third surface and the fourth surface together, the retentive section consisting of a loop integrally protruding from the third surface to define a slot and a tongue perpendicularly extending from the fourth surface, the tongue further including a clasp to snap with the loop of the third surface through the slot;

a grounding portion integrally extending from one of the surfaces away from the shell means.

* * * * *